US010449794B2

(12) United States Patent
Yabe et al.

(10) Patent No.: US 10,449,794 B2
(45) Date of Patent: Oct. 22, 2019

(54) METHOD FOR FORMING IMAGE AND PROTECTIVE LAYER AND APPARATUS THEREFOR

(71) Applicant: Dai Nippon Printing Co., Ltd., Tokyo (JP)

(72) Inventors: Suguru Yabe, Tokyo (JP); Hideki Sekiguchi, Tokyo (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days.

(21) Appl. No.: 15/748,276

(22) PCT Filed: Sep. 7, 2016

(86) PCT No.: PCT/JP2016/076314

§ 371 (c)(1),
(2) Date: Jan. 29, 2018

(87) PCT Pub. No.: WO2017/047471

PCT Pub. Date: Mar. 23, 2017

(65) Prior Publication Data

US 2018/0222238 A1 Aug. 9, 2018

(30) Foreign Application Priority Data

Sep. 18, 2015 (JP) ..... 2015-185323

(51) Int. Cl.
*B41J 2/325* (2006.01)
*B41M 7/00* (2006.01)
(Continued)

(52) U.S. Cl.
CPC ..... *B41M 7/0054* (2013.01); *B41J 2/32* (2013.01); *B41J 2/325* (2013.01); *B41M 5/382* (2013.01); *B41J 2202/31* (2013.01)

(58) Field of Classification Search
CPC ..... B41M 7/0054; B41J 2/325; B41J 2202/31
See application file for complete search history.

(56) References Cited

U.S. PATENT DOCUMENTS 4,666,320 A * 5/1987 Kobayashi ..... B41M 5/44 347/176
4,887,094 A 12/1989 Izumi et al.
(Continued)

FOREIGN PATENT DOCUMENTS

EP 0 431 621 A2 6/1991
JP H01-275067 A1 11/1989
(Continued)

OTHER PUBLICATIONS

Machine-generated translation of JP 01-275067, published on Nov. 1989.*

(Continued)

*Primary Examiner* — Huan H Tran
(74) *Attorney, Agent, or Firm* — Burr & Brown, PLLC

(57) ABSTRACT

A method for forming an image and a protective layer on a transfer receiving material, by thermal transfer, including supplying a thermal transfer sheet between a thermal head of a thermal printer and a platen roller, wherein the thermal transfer sheet includes color material layers and a transferable protective layer arranged in a face serial manner, and wherein the thermal head includes heat generating portions arranged substantially in parallel with each other; thermally transferring the color material layers to form an image on the transfer receiving material; thermally transferring the transferable protective layer to form a protective layer on the transfer receiving material; and shifting the relative positions of the thermal head and the transfer receiving material with respect to each other, in a direction substantially in
(Continued)

parallel with a main scanning direction, after transferring the color material layers at least once.

2 Claims, 2 Drawing Sheets

(51) Int. Cl.
*B41M 5/382* (2006.01)
*B41J 2/32* (2006.01)

(56) References Cited

U.S. PATENT DOCUMENTS

| | | | | |
|---|---|---|---|---|
| 7,154,520 | B2 | 12/2006 | Fukui | |
| 8,174,549 | B2 * | 5/2012 | Murakami | B41J 2/325 347/171 |
| 8,553,054 | B2 * | 10/2013 | Yasumatsu | B41M 5/38264 347/176 |

FOREIGN PATENT DOCUMENTS

| | | | |
|---|---|---|---|
| JP | H06-336043 | A1 | 12/1994 |
| JP | 2005-125747 | A1 | 5/2005 |
| JP | 2011-213070 | A1 | 10/2011 |
| JP | 2015-047752 | A1 | 3/2015 |

OTHER PUBLICATIONS

International Search Report and Written Opinion (Application No. PCT/JP2016/076314) dated Nov. 29, 2016.

English translation of the International Preliminary Report on Patentability (Chapter I) (Application No. PCT/JP2016/076314) dated Mar. 29, 2018, 7 pages.

Extended European Search Report (Application No. 16846342.0) dated Apr. 3, 2019.

* cited by examiner

METHOD FOR FORMING IMAGE AND PROTECTIVE LAYER AND APPARATUS THEREFOR

BACKGROUND OF THE INVENTION

Field of the Invention

The present invention relates to a method for forming an image and a protective layer, and an apparatus therefor.

Background Art

Conventionally, a method is known in which image formation is performed using a thermal transfer sheet including color material layers which contain color materials, such as dyes, and by transferring the color materials onto an image receiving sheet. In such an image forming method, the formation of an image is carried out by: layering the thermal transfer sheet, and the image receiving sheet, which is a transfer receiving material; applying thermal energy provided by a heat source referred to as a thermal head to the thermal transfer sheet; and transferring the color materials of the thermal transfer sheet onto the image receiving sheet, which is the transfer receiving material. The image formation carried out by such a thermal transfer method allows for a gray scale adjustment by controlling the amount of energy applied from the thermal head to the thermal transfer sheet on a dot-by-dot basis, and is capable of forming of a high quality image comparable to a full-color photograph, which is extremely vivid as well as excellent in transparency, and color reproducibility and gradation of halftone.

A portion of the thermal energy provided for carrying out the thermal transfer is also applied to the surface of the transfer receiving material (image receiving sheet) through the thermal transfer sheet. The thermal head, which is the heat source for carrying out the thermal transfer, usually has a structure in which a plurality of heat generating elements is arranged in parallel with each other in a main scanning direction, on a pixel-by-pixel basis. When the thermal energy from the thermal head is applied to the thermal transfer sheet, the entirety of the thermal head does not function as an evenly heated heat source, and the temperature difference occurs between the portions of the thermal head at which the heat generating elements are provided (heat generating portions), and the portions thereof between the respective heat generating elements (non-heat generating portions). As a result, the thermal energy transferred to the surface of the transfer receiving material through the thermal transfer sheet will be unevenly distributed, corresponding to the temperature difference between the heat generating portions and the non-heat generating portions of the thermal head. This causes the occurrence of irregularities on the surface of the image receiving sheet, which is the transfer receiving material, thereby decreasing the smoothness and glossiness of the resulting image surface.

In view of the above mentioned problems, JP 6-336043 A (Patent Document 1) discloses an image forming method in which, after transferring color materials onto the surface of a transfer receiving material by thermal transfer, a line heater including a heat generating portion(s) extending continuously therein is used to transfer a transferable protective layer of a thermal transfer sheet onto the transfer receiving material, to form a protective layer thereon, so that the smoothness and glossiness of the resulting image can be improved. However, in the above described image forming method, it is necessary to prepare a thermal transfer printer which comprises a thermal head for forming an image, and the line heater for transferring the transferable protective layer. Therefore, there is a risk of an increase in the size of the printer and an increase in the production cost.

Further, JP 2005-125747 A (Patent Document 2) discloses an image forming method which utilizes a printer in which a pressing surface is provided on the surface of a thermal head, at a portion downstream in a transport direction of a transfer receiving material onto which an image has been formed. In this method, after transferring a transferable protective layer to form a protective layer on the image, the projected portions of the surface of the protective layer are pressed to flatten by the pressing surface of the thermal head, so that the smoothness and the glossiness of the surface of the protective layer can be improved.

PRIOR ART DOCUMENTS

Patent Documents

Patent Document 1: JP 6-336043 A
Patent Document 2: JP 2005-125747 A

SUMMARY OF THE INVENTION

Problems to be Solved by the Invention

The present inventors have realized that, since the heat generating portions of the thermal head are arranged in parallel with each other in the main scanning direction, it is possible to prevent the formation of irregularities, by shifting the relative positions of the thermal head and the transfer receiving material with respect to each other, in a direction substantially in parallel with the main scanning direction (the direction in which the heat generating portions are arranged), when the thermal energy is applied to the transfer receiving material.

As a result, the present inventors have discovered that, in a thermal transfer method wherein a thermal transfer sheet including a dye layer(s) and a transferable protective layer on a substrate is used, and wherein the dye layer(s) and the transferable protective layer are transferred onto a transfer receiving material by heat of a thermal head which comprises a plurality of heat generating portions extending substantially in parallel with each other, to form an image and a protective layer on the transfer receiving material, it is possible to improve the smoothness and the glossiness of the surfaces of the image and the protective layer formed on the transfer receiving material, by shifting the relative positions of the thermal head and the transfer receiving material with respect to each other, in the direction substantially in parallel with the main scanning direction.

Accordingly, an object of the present invention is to provide a thermal transfer method capable of improving the smoothness and the glossiness of the surfaces of the image and the protective layer.

Means for Solving the Problems

The method for forming an image and a protective layer on a transfer receiving material, by thermal transfer, according to the present invention, is characterized in that the method comprises:

supplying a thermal transfer sheet between a thermal head of a thermal printer and a platen roller disposed opposite to the thermal head, wherein the thermal transfer sheet comprises a plurality of color material layers and a transferable protective layer which are arranged in a face serial manner, and wherein the thermal head comprises a plurality of heat generating portions which is arranged so as to extend substantially in parallel with each other;

transferring the color material layers of the thermal transfer sheet onto the transfer receiving material, by heat of the thermal head, to form an image on the transfer receiving material;

transferring the transferable protective layer of the thermal transfer sheet onto the transfer receiving material, by heat of the thermal head, to form a protective layer on the transfer receiving material; and shifting the relative positions of the thermal head and the transfer receiving material with respect to each other, in a direction substantially in parallel with a main scanning direction, after transferring the color material layers at least once.

In an embodiment of the present invention, shifting the relative positions of the thermal head and the transfer receiving material with respect to each other, in the direction substantially in parallel with the main scanning direction, is preferably carried out after transferring the color material layers, and before transferring the protective layer, onto the transfer receiving material.

In an embodiment of the present invention, it is preferred that when a dot pitch of the plurality of heat generating portions of the thermal head is taken as p, and a distance by which the relative positions of the thermal head and the transfer receiving material with respect to each other are to be shifted is taken as q, p and q satisfy the following Inequality (1):

$$0.4 \leq q/p \leq 0.6 \quad (1).$$

An apparatus for forming an image and a protective layer, according to another embodiment of the present invention, is characterized in that the apparatus comprises: a thermal head including a plurality of heat generating portions which is arranged so as to extend substantially in parallel with each other; and a shifting unit shifting the relative positions of the thermal head and a transfer receiving material with respect to each other, in a direction substantially in parallel with a main scanning direction.

Effect of the Invention

According to the present invention, it is possible to improve the smoothness and the glossiness of the surfaces of the image and the protective layer formed on the transfer receiving material, by shifting the relative positions of the thermal head and the transfer receiving material with respect to each other, in the direction substantially in parallel with the main scanning direction.

DETAILED DESCRIPTION OF THE INVENTION

The thermal transfer method according to the present invention comprises:

supplying a thermal transfer sheet between a thermal head of a thermal printer and a platen roller disposed opposite to the thermal head, wherein the thermal transfer sheet comprises a plurality of color material layers and a transferable protective layer which are arranged in a face serial manner, and wherein the thermal head comprises a plurality of heat generating portions which is arranged so as to extend substantially in parallel with each other;

transferring the color material layers of the thermal transfer sheet onto the transfer receiving material, by heat of the thermal head, to form an image on the transfer receiving material;

transferring the transferable protective layer of the thermal transfer sheet onto the transfer receiving material, by heat of the thermal head, to form a protective layer on the transfer receiving material; and shifting the relative positions of the thermal head and the transfer receiving material with respect to each other, in a direction substantially in parallel with a main scanning direction, after transferring the color material layers at least once.

<Supplying>

First, the thermal transfer sheet is supplied between the thermal head of the thermal printer and the platen roller disposed opposite to the thermal head. The thermal head and the platen roller are preferably disposed so as to be pressable against each other, with the color material layers and the transferable protective layer provided on the thermal transfer sheet and a receiving layer provided on the transfer receiving material being layered and sandwiched therebetween.

(Thermal Transfer Sheet)

Figure 1:
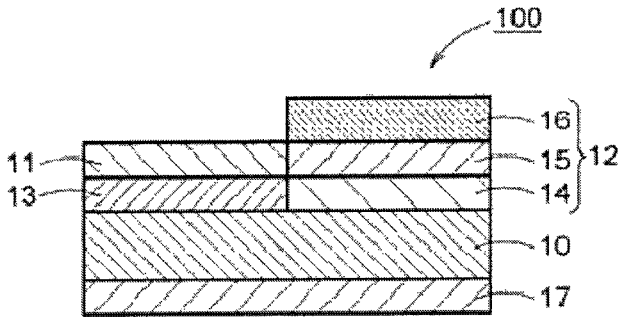
FIG. 1 is a schematic sectional view showing one embodiment of a thermal transfer sheet to be used in the method according to the present invention.

The thermal transfer sheet can be fed from a supply roll, to be supplied between the thermal head and the platen roller. The thermal transfer sheet to be used in the method according to the present invention comprises, as shown in FIG. 1, at least a substrate 10, a color material layer 11 and a transferable protective layer 12. The color material layer 11 and the transferable protective layer 12 are layers to be transferred to the transfer receiving material, by thermal transfer, as will be described later.

A thermal transfer sheet 100 comprises, on one surface of the substrate 10, the color material layer 11 and the transferable protective layer 12, which are arranged in a face serial manner.

The thermal transfer sheet 100 may optionally comprise a color material primer layer 13 between the color material layer 11 and the substrate 10.

The transferable protective layer 12 may have a multilayer structure composed of a peeling layer 14, a primer layer 15 and an adhesive layer 16.

Further, the thermal transfer sheet 100 may optionally comprise a heat-resistant lubricant layer 17 on the surface of the substrate 10 opposite from the surface provided with the color material layer 11 and the transferable protective layer 12.

The thermal transfer sheet 100 may further comprise a release layer (not shown) between the transferable protective layer 12 and the substrate 10.

The thermal transfer sheet 100 may further comprise a back-surface primer layer (not shown) between the heat-resistant lubricant layer 17 and the substrate 10.

Each of the layers constituting the thermal transfer sheet will be described below.

There is no particular limitation on the material for constituting the substrate, and it is possible to use any material which has: heat resistance capable of withstanding the heat of the thermal head; mechanical strength capable of supporting the color material layer and the transferable protective layer; and solvent resistance. Examples of the material comprise: polyester resins such as polyethylene terephthalate (PET), polybutylene terephthalate, polyethylene naphthalate, polyethylene terephthalate-isophthalate copolymers, and polyethylene terephthalate/polyethylene naphthalate; polyimide resins such as Nylon-6 and Nylon-6,6; polyolefin resins such as polyethylene, polypropylene and polymethylpentene; vinyl resins such as polyvinyl chloride; (meth)acrylic resins such as polyacrylate, polymethacrylate and polymethylmethacrylate; imide resins such as polyimide and polyetherimide; engineering resins such as polyarylate, polysulfone, polyethersulfone, polyphenylene ether, polyphenylene sulfide (PPS), polyaramid, polyether ketone, polyether nitrile, polyether ether ketone and polyether sulfite; styrene resins such as polycarbonate, polystyrene, high impact polystyrene, acrylonitrile-styrene copolymers (AS resins) and acrylonitrile-butadiene-styrene copolymers (ABS resins); and cellulose resins such as cellophane, cellulose acetate and nitrocellulose.

The substrate may be made of a copolymer resin or a mixed product (including an alloy) containing any of the above described resins as major components, or may be a laminate composed of a plurality of layers. Further, the substrate may be a stretched film or an unstretched film. However, it is preferred that a uniaxially or biaxially stretched film be used in order to improve the strength. The substrate is used in the form of a film, a sheet or a board composed of at least one layer made of any of these resins. Among the substrates composed of the above mentioned resins, a polyester film made of PET, polyethylene naphthalate or the like is suitably used because of its excellent heat resistance and mechanical strength. In particular, a PET film is more preferred.

It is preferred that at least one surface of the substrate be surface treated. The surface treatment of the substrate allows for improving the adhesion between the substrate and an arbitrary layer to be provided on the substrate. The surface treatment may be, for example, a corona discharge treatment, a flame treatment, an ozone treatment, a UV light treatment, a radiation treatment, a surface roughening treatment, a chemical treatment, a plasma treatment, a low-temperature plasma treatment, a primer treatment or a graft treatment. Two or more of these may be combined to carry out the surface treatment.

The substrate preferably has a thickness of 0.5 μm or more and 50 μm or less, and more preferably 1 μm or more and 10 μm or less. When the substrate has a thickness of 0.5 μm or more and 50 μm or less, it is possible to satisfy both the transferability of the thermal energy, and the mechanical strength.

The color material layer of the thermal transfer sheet is thermal transferable, and it is possible to use a dye layer or a heat-meltable ink layer as described below, as the color material layer. In cases where the thermal transfer sheet is a sublimable thermal transfer sheet, the color material layer is a layer (dye layer) containing a sublimation dye. In cases where the thermal transfer sheet is a heat-meltable thermal transfer sheet, the color material layer is a layer (heat-meltable ink layer) containing a heat-meltable ink composed of a heat-meltable composition containing a colorant. Further, a layer region containing a sublimation dye, and a layer region containing a heat-meltable ink composed of a heat-meltable composition containing a colorant, may be provided on one continuous substrate, in a face serial manner.

Description will be given below regarding the color material layer, with reference to the dye layer as an example. However, the color material layer is not limited thereto, and the color material layer may be the heat-meltable ink layer. Although any conventionally known dye can be used as a material for the dye layer, it is preferred to use one having favorable properties as a printing material, such as for example, a dye having sufficient coloring concentration and whose color does not change or fade due to light, heat and temperature conditions. The dye layer may be, for example, a yellow dye layer, a magenta dye layer, a cyan dye layer, or a black dye layer; and the thermal transfer sheet can comprise one of these dye layers, or two or more types thereof which are arranged in a face serial manner.

The sublimation dye is not particularly limited. However, it is preferred to use a dye having sufficient coloring concentration and whose color does not change or fade due to light, heat and temperature conditions. Example of the sublimation dye as described above comprise: diarylmethane dyes; triarylmethane dyes; thiazole dyes; merocyanine dyes, pyrazolone dyes; methine dyes; indoaniline dyes; azomethine dyes such as acetophenone azomethine, pyrazolo azomethine, imidazole azomethine, imidazo azomethine and pyridone azomethine; xanthene dyes; oxazine dyes; cyanostyrene dyes such as dicyanostyrene and tricyanostyrene; thiazine dyes; azine dyes; acridine dyes; benzeneazo dyes; azo dyes such as pyridoneazo, thiopheneazo, isothiazoleazo, pyrroleazo, pyrazoleazo, imidazoleazo, thiadiazoleazo, triazoleazo and disazo; spiropyran dyes; indolinospiropyran dyes; fluoran dyes; rhodaminelactam dyes; naphthoquinone dyes; anthraquinone dyes; and quinophthalone dyes. More specific examples thereof comprise: red dyes such as MS Red G (manufactured by Mitsui Toatsu Chemicals, Inc.), Macrolex Red Violet R (manufactured by Bayer Aktiengesellschaft), CeresRed 7B (manufactured by Bayer Aktiengesellschaft) and Samaron Red F3BS (manufactured by Mitsubishi Chemical Corporation); yellow dyes such as Holon Brilliant Yellow 6GL (manufactured by Clariant Co.), PTY-52 (manufactured by Mitsubishi Chemical Corporation) and MACROLEX Yellow 6G (manufactured by Bayer Aktiengesellschaft); and blue dyes such as Kayaset (registered trademark) Blue 714 (manufactured by Nippon Kayaku Co., Ltd.), Waxoline Blue AP-FW (manufactured by ICI), Holon Brilliant Blue S-R (manufactured by Sandoz K.K.), MS Blue 100 (manufactured by Mitsui Toatsu Chemicals, Inc.) and C. I. Solvent Blue 22.

It is preferred that the color material layer comprise a binder resin; and examples thereof comprise: cellulose resins such as ethyl cellulose, hydroxyethyl cellulose, ethylhydroxy cellulose, hydroxypropyl cellulose, methyl cellulose, cellulose acetate and cellulose butyrate; vinyl resins such as polyvinyl alcohol, polyvinyl acetate, polyvinyl butyral, polyvinyl acetoacetal and polyvinyl pyrrolidone; acrylic resins such as poly (meth)acrylate and poly(meth)acrylamide; polyurethane resins; polyamide resins; and polyester resins. Among the above described binder resins, preferred are cellulose resins, vinyl resins, acrylic resins, urethane resins, phenoxy resins and polyester resins; more preferred are vinyl resins; and particularly preferred are polyvinyl butyral and polyvinyl acetoacetal, because they have an excellent heat resistance and dye transferability.

The color material layer can be formed, for example, by the following method.

First, to the dye and the binder resin, an additive such as a release agent or the like is added as necessary, and the resulting mixture is dissolved or dispersed in an appropriate organic solvent such as toluene or methyl ethyl ketone, or water, to prepare a coating liquid (a solution or a dispersion liquid) for forming the color material layer. Then the resulting coating liquid is coated on one surface of the substrate, by a formation means such as, for example, a gravure printing method, a reverse roll coating method using a gravure plate, a roll coater, or a bar coater, and then dried, to form the color material layer. The coating amount of the coating liquid is preferably 0.2 $g/m^2$ or more and 5.0 $g/m^2$ or less, in a dried state. The color material layer preferably has a thickness of 0.2 μm or more and 5 μm or less.

The transferable protective layer may have a monolayer structure, or a multi-layer structure. However, the transferable protective layer preferably has a multi-layer structure, and it may be, for example, one composed of the peeling layer, the primer layer and the adhesive layer.

The peeling layer is a layer provided on the substrate, and it is to be peeled off from the substrate and transferred onto the transfer receiving material. After being transferred, the peeling layer will be located at the outermost surface of the protective layer, and will be substantially responsible for protecting the formed image and the like.

The peeling layer can contain a thermoplastic resin, a thermosetting resin and/or a UV absorbing resin; and examples thereof comprise: thermoplastic resins, for example, (meth)acrylic resins such as poly(meth)acrylamide, polymethyl (meth)acrylate and polyethyl (meth)acrylate; and vinyl resins such as polyvinyl acetate and vinyl chloride-vinyl acetate copolymers; thermosetting resins, for example, unsaturated polyesters; polyester resins; polyurethane resins; and cellulose resins; and UV absorbing resins.

Among these, (meth)acrylic resins and cellulose resins are preferred. More specifically, polymethyl (meth)acrylate, polyethyl (meth)acrylate and cellulose acetate propionate are preferred. When the peeling layer contains such a resin, it is possible to improve the smoothness and the glossiness after the transfer, while maintaining light resistance and durability.

The peeling layer may contain one type, or two or more types of the above described thermoplastic resins and thermosetting resins.

As the UV absorbing resin, it is possible to use, for example, a resin obtained by allowing a reactive UV absorber to react and to bind (polymerize) with a thermoplastic resin or an ionizing radiation-curable resin. The term "reactive UV absorber" as used herein refers to a compound obtained by introducing a reactive group, such as an addition polymerizable double bond (for example, a vinyl group, an acryloyl group, a methacryloyl group or the like), an alcoholic hydroxyl group, an amino group, a carboxyl group, an epoxy group or an isocyanate group, into a conventionally known nonreactive organic UV absorber, such as a salicylate-based, benzophenone-based, benzotriazole-based, triazine-based, substituted acrylonitrile-based, nickel chelate-based or hindered amine-based UV absorber.

The peeling layer preferably contains any of various types of release agents, in order to improve the transferability, namely, releasability from the substrate. Examples of the release agent comprise waxes, silicone waxes, phosphoric acid esters, silicone resins, silicone-modified resins, fluorine resins, fluorine-modified resins, polyvinyl alcohols, acrylic resins, thermally crosslinkable epoxy-amino resins and thermally crosslinkable alkyd-amino resins.

The peeling layer can be formed, for example, by the following method. First, any of the thermoplastic resins and/or the thermosetting resins, and a UV absorber and/or any of various types of additives to be added as necessary, are dissolved or dispersed in an appropriate organic solvent or water, to prepare a coating liquid (a solution or a dispersion liquid) for forming the peeling layer. Then the resulting coating liquid is coated on one surface of the substrate by a known coating method, and then dried, to form the peeling layer. The coating amount of the coating liquid is preferably 0.2 $g/m^2$ or more and 10 $g/m^2$ or less, in a dried state. The peeling layer preferably has a thickness of 0.2 μm or more and 10 μm or less.

The primer layer may be provided between the peeling layer and the adhesive layer. The primer layer is a layer which is provided arbitrarily as one of the layers constituting the transferable protective layer. When the primer layer is provided, it is possible to improve the adhesion between the peeling layer and the adhesive layer.

It is preferred that the primer layer contain a resin; and examples thereof comprise: polyester resins; vinyl resins such as polyvinyl acetate, polyvinyl acetoacetal, polyvinyl butyral, polyvinyl acetal, polyvinyl pyrrolidone and polyvinyl alcohol; cellulose resins such as hydroxyethyl cellulose; polyacrylate resins; polyurethane resins; styrene acrylate resins; acrylic resins such as poly(meth)acrylamide; polyamide resins; polyether resins; polystyrene resins; and polyolefin resins such as polyethylene and polypropylene.

When the primer layer contains any of the above described resins, it is possible to improve the adhesion between the peeling layer and the adhesive layer. In addition, it is also possible to improve the heat resistance of the primer layer, as well as to prevent the peeling layer and the adhesive layer from mixing with each other, during the coating, thereby improving the quality of the resulting image.

Further, the primer layer preferably contains fine particles. The incorporation of fine particles into the primer layer allows for preventing the occurrence of rainbow unevenness. The fine particles preferably have an average primary particle diameter of 100 nm or less, and more preferably 50 nm or less. At the same time, the fine particles preferably have an average primary particle diameter of 8 nm or more. When the average primary particle diameter of the fine particles is within the above mentioned numerical range, it is possible to prevent the occurrence of rainbow unevenness in the resulting protective layer, as well as to maintain the transparency of the protective layer. Note that the "average primary particle diameter" can be measured by the BET (specific area measurement) method, in accordance with JIS Z 8830 (issued: 2013).

Further, the fine particles may be inorganic fine particles or organic fine particles, as long as the fine particles are colorless or white so that the transparency of the resulting protective layer is not compromised. However, inorganic fine particles are preferred, in terms of the hardness and the heat resistance of the particles. In particular, the fine particles are preferably colloidal ultrafine particles of an inorganic pigment. The colloidal ultrafine particles of an inorganic pigment may be, for example, particles of: silica (colloidal silica), alumina or alumina hydrate (alumina sol, colloidal alumina, cationic aluminum oxide or a hydrate thereof, pseudo boehmite or the like), aluminum silicate, magnesium silicate, magnesium carbonate, magnesium oxide, or titanium oxide. In particular, colloidal silica or alumina sol is preferably used.

In addition, the primer layer may further contain any of additives, such as, for example, agents for improving coating performance such as leveling agents and antifoaming agents, fluorescent whitening agents, and UV absorbers.

The primer layer can be formed, for example, by the following method. First, the above described fine particles, and any of the additives to be added as necessary, are dissolved or dispersed in an appropriate organic solvent or water, to prepare a coating liquid (a solution or a dispersion liquid) for forming the primer layer. Then the resulting coating liquid is coated on the peeling layer by a known coating method, and then dried, to form the primer layer. The coating amount of the coating liquid is preferably 0.03 $g/m^2$ or more and 1.0 $g/m^2$ or less, in a dried state.

There is no particular limitation on the material for forming the adhesive layer, and any material conventionally known as a material for forming an adhesive layer in a protective layer transfer sheet can be selected as appropriate and used. For example, the adhesive layer can contain, as a binder resin, any of the following resins: UV absorbing copolymer resins, acrylic resins, vinyl chloride-vinyl acetate copolymer resins, epoxy resins, polyester resins, polycarbonate resins, butyral resins, polyamide resins, vinyl resins, and the like.

The adhesive layer can be formed by a method as described below. Specifically, any of the binder resins as exemplified above, and a UV absorber, an antioxidant, a fluorescent whitening agent, an inorganic or organic filler component, a surfactant, a release agent and/or the like to be added as necessary, are dispersed or dissolved in an appropriate solvent, to prepare a coating liquid for forming the adhesive layer. The resulting coating liquid is coated by a method such as gravure coating or gravure reverse coating, such that the resulting coated layer will be the outermost layer of the thermal transfer sheet, namely, the outermost layer of the transferable protective layer (for example, on the primer layer), and then dried, to form the adhesive layer. The thickness of the adhesive layer is not particularly limited. However, the adhesive layer preferably has a thickness of about 0.5 μm or more and 10 μm or less, and more preferably about 0.8 μm or more and 2 μm or less.

In cases where the transferable protective layer consists of a monolayer, the transferable protective layer can contain any of the thermoplastic resins, thermosetting resins and UV absorbing resins as described above. Examples thereof comprise: thermoplastic resins, for example, (meth)acrylic resins such as poly(meth)acrylamide, polymethyl (meth)acrylate and polyethyl (meth)acrylate; and vinyl resins such as polyvinyl acetate and vinyl chloride-vinyl acetate copolymers; thermosetting resins, for example, unsaturated polyesters; polyester resins; polyurethane resins; cellulose resins; butyral resins; and polycarbonate resins; and UV absorbing resins.

Among the above described resins, it is preferred that the transferable protective layer contain a mixture of a (meth) acrylic resin and a UV absorbing resin, in terms of improving the abrasion resistance and the light resistance of the resulting protective layer.

Further, the transferable protective layer can optionally contain any of additives, such as, for example, release agents, agents for improving coating performance such as leveling agents and antifoaming agents, fluorescent whitening agents, and UV absorbers.

In this case, the transferable protective layer can be formed by: dissolving or dispersing any of the above descried resins and the like in an appropriate organic solvent or water, to prepare a coating liquid (a solution or a dispersion liquid); coating the resulting coating liquid on one surface of the substrate by a known coating method; and then drying the coating. The coating amount of the coating liquid is preferably 0.2 $g/m^2$ or more and 10 $g/m^2$ or less, in a dried state.

The thermal transfer sheet optionally comprises the color material primer layer between the color material layer and the substrate. When the thermal transfer sheet comprises the color material primer layer, it is possible to improve the adhesion between the color material layer and the substrate. There is no particular limitation on the material for constituting the color material primer layer, and any material can be used as long as it exhibits a favorable adhesion to both the color material layer and the substrate. The color material primer layer preferably has a thickness of 0.05 μm or more and 10 μm or less.

The thermal transfer sheet may optionally comprise the heat-resistant lubricant layer on the surface of the substrate opposite from the surface provided with the color material layer and the transferable protective layer. The heat-resistant lubricant layer can be formed by selecting, as appropriate, a conventionally known thermoplastic resin and the like. Examples of such a thermoplastic resin comprise: polyester resins; polyacrylate resins; styrene acrylate resins; polyurethane resins; polyolefin resins such as polyethylene and polypropylene; polystyrene resins; vinyl resins such as polyvinyl chloride, polyvinyl acetate, polyvinyl chloride, polyvinyl butyral and polyvinyl acetoacetal; polyether resins; polyamide resins; polyimide resins; polyamideimide resins; polycarbonate resins; acrylic resins, and cellulose resins; as well as silicone-modified products of the above described thermoplastic resins.

Among these, vinyl resins, polyamideimide resins and silicone-modified products thereof are preferred. More specifically, polyvinyl butyral, polyamide and cellulose acetate butyrate are preferred. When the heat-resistant lubricant layer contains such a resin, it is possible to improve the transfer stability, and thus, to prevent the occurrence of wrinkles in the thermal transfer sheet and/or the resulting protective layer, as well as the generation of printing residue, during the formation of an image and the formation of the protective layer.

In order to further improve the heat resistance of the heat-resistant lubricant layer, it is preferred to use a hydroxyl group-containing resin, among the above mentioned resins, and to further use polyisocyanate in combination, as a crosslinking agent.

It is preferred that the heat-resistant lubricant layer contain any of various types of additives. Examples of additives comprise: agents for imparting slip characteristics such as waxes, higher fatty acid amides, phosphoric acid ester compounds, metal soaps and silicone oils; release agents such as surfactants; organic powders such as fluorine resins; and inorganic particles such as silica, clay, talc and calcium carbonate.

The heat-resistant lubricant layer can be formed, for example, by the following method. First, any of the above described resins, and an isocyanate compound, an agent for imparting slip characteristics, a surfactant and/or the like to be added as necessary, are dissolved or dispersed in an appropriate organic solvent or water, to prepare a coating liquid (a solution or a dispersion liquid) for forming the heat-resistant lubricant layer. Then the resulting coating liquid is coated on the substrate by a known coating method, and then dried, to form the heat-resistant lubricant layer. The coating amount of the coating liquid is preferably 0.1 g/m$^2$ or more and 5 g/m$^2$ or less, in a dried state. The heat-resistant lubricant layer preferably has a thickness of 0.1 μm or more and 5 μm or less.

The thermal transfer sheet may optionally further comprise the back-surface primer layer between the heat-resistant lubricant layer and the substrate. When the thermal transfer sheet comprises the back-surface primer layer, it is possible to improve the adhesion between the heat-resistant lubricant layer and the substrate. There is no particular limitation on the material for constituting the back-surface primer layer, and any material can be used as long as it exhibits a favorable adhesion to both the heat-resistant lubricant layer and the substrate. The back-surface primer layer preferably has a thickness of 0.05 μm or more and 10 μm or less.

The thermal transfer sheet may optionally further comprise the release layer between the transferable protective layer and the substrate. The release layer is a layer responsible for adjusting the peel force between the substrate and the transferable protective layer, and remains on the side of the substrate after the transfer.

The release layer can contain any of the release agents, such as, for example, waxes, phosphoric acid esters, silicone resins, silicone-modified resins, fluorine resins, fluorine-modified resins, cellulose resins, polyvinyl alcohols, acrylic resins, thermally crosslinkable epoxy-amino resins and thermally crosslinkable alkyd-amino resins.

The release layer can be formed, for example, by the following method. First, any of the above described materials and the like are dissolved or dispersed in an appropriate organic solvent or water, to prepare a coating liquid (a solution or a dispersion liquid) for forming the peeling layer. Then the resulting coating liquid is coated on one surface of the substrate by a known coating method, and then dried, to form the peeling layer. The coating amount of the coating liquid is preferably 0.2 g/m$^2$ or more and 10 g/m$^2$ or less, in a dried state. The release layer preferably has a thickness of 0.2 μm or more and 10 μm or less.

(Transfer Receiving Material)

Figure 2:
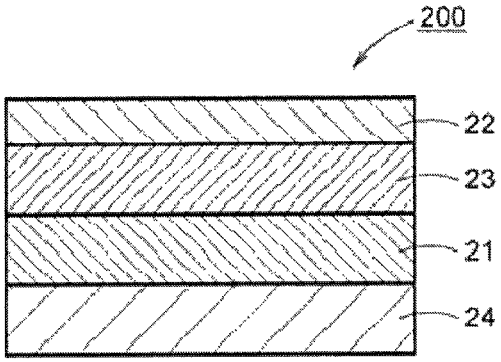
FIG. 2 is a schematic sectional view showing one embodiment of a transfer receiving material to be used in the method according to the present invention.

The transfer receiving material can also be fed from a supply roll, to be supplied between the thermal head and the platen roller. In one embodiment, a transfer receiving material 200 to be used in the method according to the present invention comprises a substrate sheet 21 and a receiving layer 22 (see FIG. 2).

Further, the transfer receiving material 200 may comprise an intermediate layer 23 between the substrate sheet 21 or a porous layer to be described later, and the receiving layer 22. Still further, the transfer receiving material 200 may optionally comprise a back layer 24 on the surface of the substrate sheet 21 opposite from the surface provided with the receiving layer 22. In addition, the transfer receiving material 200 may optionally comprise the porous layer between the substrate sheet 21 and the receiving layer 22, and further, an anchoring layer (not shown) between the substrate sheet 21 and the porous layer. Each of the layers constituting the transfer receiving material will be described below.

The substrate sheet has a function of protecting the receiving layer. Since heat is applied to the transfer receiving material during the thermal transfer, it is preferred that the substrate sheet has a mechanical strength sufficient enough not to cause any inconvenience in handling, even in a heated state. There is no particular limitation on the material for such a substrate sheet, and it is possible to use, for example, a condenser paper, a glassine paper, a vegetable parchment paper, a synthetic paper (polyolefin-based, polystyrene-based synthetic paper or the like), a high quality paper, an art paper, a coated paper (RC base paper), a cast-coated paper, a wall paper, a backing paper, a synthetic resin or emulsion-impregnated paper, a synthetic rubber latex-impregnated paper, a synthetic resin internally-added paper or a paperboard; a cellulose fiber paper, or a resin coated paper obtained by coating both surfaces of a cellulose paper with polyethylene and used as a substrate for a printing paper for silver halide photography. Alternatively, it is also possible to use any of various types of films and sheets made of a plastic, such as polyester, polyacrylate, polycarbonate, polyurethane, polyimide, polyetherimide, a cellulose derivative, polyethylene, an ethylene-vinyl acetate copolymer, polypropylene, polystyrene, acrylic, polyvinyl chloride, or polyvinylidene chloride.

Further, it is also possible to use a film (porous film) having minute cavities (microvoids) in the interior thereof, which can be obtained by adding a white pigment or a filler to a synthetic resin, followed by film formation.

A laminate obtained by arbitrarily combining any of the above mentioned materials can also be used as a substrate sheet. A representative laminate may be, for example, a laminate of a cellulose fiber paper and a synthetic paper, or a laminate of a cellulose synthetic paper and a plastic film. Such a laminated synthetic paper may be a two-layer laminate consisting of two layers; however, it may be a three-layer laminate or a laminate consisting of three or more layers, obtained by pasting a synthetic paper, a plastic film or a porous film on both surfaces of a cellulose fiber paper (used as a core material), so that the texture or feel of the substrate can be improved. Further, the laminated synthetic paper may be a laminate obtained by coating a resin layer (hollow particle layer) containing hollow particles dispersed therein, on a surface of a coated paper, a resin coated paper, a plastic film or the like, so as to impart heat insulation properties to the laminate.

The above mentioned laminates can be produced by pasting the materials with each other, using a method such as dry lamination, wet lamination, extrusion or the like. In addition, the lamination of the hollow particle layer as described above can be carried out by using a coating means such as gravure coating, comma coating, blade coating, die coating, slide coating, curtain coating or the like, but not limited thereto.

The thickness of the substrate as described above is not particularly limited, and the substrate usually has a thickness of about 10 μm or more and 300 μm or less. In cases where the substrate as described above has a poor adhesion to a layer to be formed on the surface thereof, it is preferred that the surface of the substrate be subjected to a surface treatment with any of various types of primers or a corona discharge treatment. Further, in the case of providing the hollow particle layer, it is preferred that the hollow particle layer be coated simultaneously with the receiving layer or another layer(s) by multi-layer coating, using a slide coating or curtain coating method, in terms of improving adhesion and production efficiency.

The receiving layer is a layer responsible for receiving the sublimation dye(s) transferred from the thermal transfer sheet, and retaining the formed image. The receiving layer can contain a resin; and examples thereof comprise polycarbonate resins, polyester resins, polyamide resins, acrylic resins, acrylic-styrene resins, cellulose resins, polysulfone resins, vinyl resins, vinyl chloride-acrylic resins, vinyl chloride-vinyl acetate copolymer resins, polyurethane resins, polystyrene resins, polypropylene resins, polyethylene resins, ethylene-vinyl acetate copolymer resins, epoxy resins, and polyvinyl alcohol resins.

Among these, the receiving layer preferably contains a polyvinyl alcohol resin, a vinyl chloride-vinyl acetate copolymer resin and/or a polyester resin. When the receiving layer contains such a resin, it is possible to improve the concentration of the image formed on the receiving layer.

Further, the receiving layer may contain two or more types of these resin materials.

The receiving layer preferably contains a release agent, and when the receiving layer contains a release agent, it is possible to improve the releasability from the thermal transfer sheet. Examples of the release agent compries: solid waxes such as polyethylene waxes, amide waxes and Teflon (registered trademark) powders; fluorine-based and phosphoric acid ester-based surfactants; silicone oils; various types of modified silicone oils such as reactive silicone oils and curable silicone oils; and various types of silicone resins. Of these, silicone oils are preferred. Although a silicone oil in an oily state can be used as the silicone oil, preferred is a curable silicone oil. Examples of the curable silicone oil comprise reaction-curable silicone oils, photo-curable silicone oils and catalyst-curable silicone oils. Of these, reaction-curable and catalyst-curable silicone oils are particularly preferred.

The receiving layer can contain a pigment or filler, such as titanium oxide, zinc oxide, kaolin, clay, calcium carbonate, finely divided silica, etc., in order to improve the whiteness of the receiving layer and to further enhance the sharpness of the transferred image. Further, the receiving layer may contain a plasticizer such as a phthalic acid ester compound, a sebacic acid ester compound, or a phosphoric acid ester compound.

The thickness of the receiving layer is not particularly limited, as long as it is within the range that allows for achieving a desired image concentration. However, the coating amount of a coating liquid for forming the receiving layer is usually 1 $g/m^2$ or more and 20 $g/m^2$ or less, and preferably 1 $g/m^2$ or more and 15 $g/m^2$ or less, in a dried state. The receiving layer can be formed using a commonly used coating means. For example, the coating liquid can be coated using a means such as a gravure printing method, a screen printing method, or a reverse roll coating method using a gravure plate, and then dried, to form the receiving layer. The receiving layer preferably has a thickness of 1 μm or more and 20 μm or less, and more preferably 1 μm or more and 15 μm or less.

The transfer receiving material may comprise the porous layer between the substrate sheet and the receiving layer. The porous layer can be formed by a layer containing hollow particles and a binder resin, or a porous film. However, in terms of improving cushioning properties, heat insulation properties and the like, the porous layer is preferably formed by a porous film. In one embodiment, the porous film contains a polypropylene resin as a base resin, and has microvoids in the interior thereof.

In order to generate microvoids inside a film, a method can be used, for example, in which the film is prepared using a compound obtained by kneading a resin which serves as a base material of the film, with organic fine particles or inorganic fine particles (one type or a plurality of types of particles may be used) which are incompatible with the resin.

The porous layer preferably has a thickness of 10 μm or more and 100 μm or less, and more preferably 20 μm or more and 50 μm or less.

The transfer receiving material may optionally further comprise the anchoring layer between the substrate sheet and the porous layer. The anchoring layer is composed of an adhesive; and examples of the adhesive which can be used comprise: polyurethane resins; polyolefin resins such as and α-olefin-maleic anhydride resins; polyester resins; (meth) acrylic resins; epoxy resins; urea resins; melamine resins; phenol resins; vinyl resins; and cyanoacrylate resins. In particular, reactive acrylic resins, modified acrylic resins and the like are preferably used.

Further, the adhesive is preferably cured using a curing agent, because it allows for improving the adhesive force as well as the heat resistance of the resulting anchoring layer. As the curing agent, polyisocyanate is usually used; however, an aliphatic amine, a cyclic aliphatic amine, an aromatic amine, an acid anhydride or the like can be used. As to the thickness of the anchoring layer, the coating amount of a coating liquid for forming the anchoring layer is preferably 0.5 $g/m^2$ or more and 10 $g/m^2$ or less, in a dried state. The anchoring layer can be formed using a commonly used coating means. Further, the anchoring layer preferably has a thickness of 0.5 μm or more and 10 μm or less, and more preferably 2 μm or more and 5 μm or less.

The transfer receiving material can optionally comprise any of conventionally known intermediate layers, for the purpose of imparting adhesion between the receiving layer and the substrate sheet, whiteness, cushioning properties, concealing properties, antistatic properties, curl resistance and the like.

The intermediate layer preferably contains a binder resin; and examples thereof comprise polyurethane resins, polyester resins, polycarbonate resins, polyamide resins, acrylic resins, polystyrene resins, polysulfone resins, polyvinyl chloride resins, polyvinyl acetate resins, vinyl chloride-vinyl acetate copolymer resins, polyvinyl acetal resins, polyvinyl butyral resins, polyvinyl alcohol resins, epoxy resins, cellulose resins, ethylene-vinyl acetate copolymer resins, polyethylene resins, and polypropylene resins. Further, an isocyanate cured product of a resin containing an active hydroxyl group, among the above described resins, may also be contained in the intermediate layer, as a binder resin.

In addition, the intermediate layer preferably contains a filler such as titanium oxide, zinc oxide, magnesium carbonate, calcium carbonate or the like, for the purpose of imparting whiteness and concealing properties. It is preferred that the intermediate layer further contain a fluorescent whitening agent, such as a stilbene compound, a benzimidazole compound, a benzoxazole compound or the like, for the purpose of improving the whiteness. Further, in order to enhance the light resistance of the resulting image, it is preferred that the intermediate layer contain a UV absorber or an antioxidant, such as a hindered amine compound, a hindered phenol compound, a benzotriazole compound, a benzophenone compound, or the like. Still further, the intermediate layer can also contain a cationic acrylic resin, a polyaniline resin, any of various types of electric conductive fillers, and/or the like, in order to impart antistatic properties.

The coating amount of a coating liquid for forming the intermediate layer is not particularly limited; however, it is preferably about 0.5 $g/m^2$ or more and 30 $g/m^2$ or less, in a dried state.

The transfer receiving material may optionally comprise the back layer on the surface of the substrate sheet opposite from the surface provided with the receiving layer. The back layer may consist of a single layer, or may be composed of two or more layers having different compositions and the like, which are laminated with each other.

The back layer may contain, for example, a polyurethane resin, a polyester resin, a polybutadiene resin, a (meth) acrylic resin, an epoxy resin, a polyamide resin, a rosin-modified phenol resin, a terpene phenol resin, a gelatin, a casein and/or the like. Further, the back layer may contain a water-soluble polymer such as a cellulose resin, a starch, a polysaccharide such as agar, or the like. Note that the water-soluble polymer as used herein refers to a polymer which is capable of completely dissolving (particle diameter of less than 0.01 μm) in an aqueous solvent, or forming a colloidal dispersion (particle diameter of 0.01 μm or more and less than 0.1 μm), an emulsion (particle diameter of 0.1 μm or more and less than 1 μm) or a slurry (particle diameter of 1 μm or more) with the aqueous solvent.

The thickness of the back layer is not particularly limited. However, the coating amount of a coating liquid for forming the back layer is preferably 0.1 $g/m^2$ or more and 3.0 $g/m^2$ or less, in a dried state. The back layer can be formed using a commonly used coating means. For example, the coating liquid can be coated using a means such as a gravure printing method or the like, and then dried, to form the back layer. Further, the back layer preferably has a thickness of 0.1 μm or more and 10 μm or less, and more preferably 0.3 μm or more and 3 μm or less.

(Thermal Printer)

The thermal printer comprises the thermal head, and the platen roller disposed opposite to the thermal head; and the thermal transfer sheet and the transfer receiving material are to be sandwiched therebetween. Further, the thermal printer to be used in the present invention comprises a shifting unit shifting the relative positions of the thermal head and the transfer receiving material with respect to each other, in the direction substantially in parallel with the main scanning direction, which will be described later. The thermal transfer sheet and the transfer receiving material are pressed against the thermal head by the rotating platen roller, and transported according to the rotation thereof. At this time, the color material layer of the thermal transfer sheet and the transfer receiving material face each other and are in contact with each other.

Figure 3:
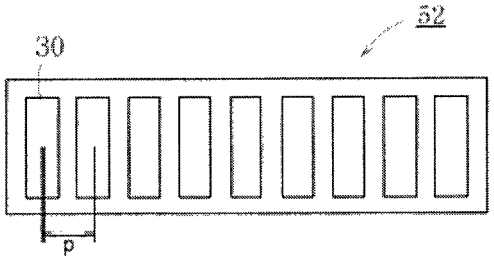
FIG. 3 is a schematic sectional view showing one embodiment of a thermal head to be used in the method according to the present invention.

As shown in FIG. 3, a thermal head 52 comprises a plurality of heat generating portions 30, which is arranged so as to extend substantially in parallel with each other. A dot pitch p, which is an interval between two adjacent heat generating portions of the thermal head, is individually defined for each thermal head. The resolution of the thermal head is also individually defined for each specification, and it is possible to improve the smoothness and the glossiness of the surfaces of the resulting image and protective layer, by adjusting a distance q, which is a distance by which the relative positions of the thermal head and the transfer receiving material with respect to each other are to be shifted, based on the dot pitch p. Note that the term "dot pitch p" as used in the present invention refers to a distance between the center of a certain heat generating portion and the center of an adjacent heat generating portion (see FIG. 3).

<Image Forming>

It is possible to form an image on the transfer receiving material which optionally comprises the receiving layer, by allowing the thermal head to generate heat according to image data, and transferring the color material(s) in the color material layer(s) of the thermal transfer sheet onto the transfer receiving material. The transfer of the color material layer(s) can be performed once, or twice or more. When the transfer is performed twice or more, it is possible to form a full color image having a high definition.

<Protective Layer Forming>

It is possible to form a protective layer on the formed image, by allowing the thermal head to generate heat, and transferring the transferable protective layer of the thermal transfer sheet onto the transfer receiving material on which the image has been formed.

<Shifting>

The method according to the present invention comprises shifting (moving) (hereinafter, sometimes referred to as a "the shifting") the relative positions of the thermal head and the transfer receiving material with respect to each other, in the direction substantially in parallel with the main scanning direction, after transferring the color material layer(s) at least once. The shifting of the method according to the present invention allows for changing the locations to be heated on the transfer receiving material, which locations have conventionally been fixed. As a result, it is possible to improve the uniformity in the distribution of the thermal energy transferred to the surface of the transfer receiving material, thereby improving the smoothness and the glossiness of the surfaces of the resulting image and protective layer.

In one embodiment, the relative positions of the thermal head and the transfer receiving material with respect to each other can be changed, by shifting the position of the thermal head, using the shifting unit, such as, for example, a stepping motor. Further, the shifting can be performed, for example, by setting the shifting unit in advance so as to move the position of the thermal head in the direction substantially in parallel with the main scanning direction, after the completion of the image formation.

Alternatively, the position of the transfer receiving material may be shifted, or the positions of both the thermal head and the transfer receiving material may be shifted, using a stepping motor or the like.

Figure 4:
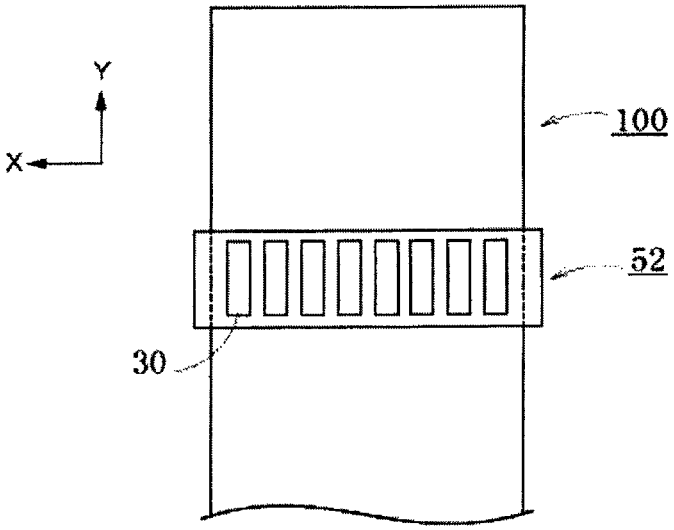
FIG. 4 is a schematic diagram showing the direction in which the relative positions of the thermal head and the transfer receiving material with respect to each other are to be shifted.

Note that the term "direction substantially in parallel with the main scanning direction" as used in the present invention refers to a direction x as shown in FIG. 4, and it does not include the vertical direction and the like. A direction y shown in FIG. 4 indicates the transport direction (sub-scanning direction) of the thermal transfer sheet 100 and the transfer receiving material 200.

The shifting can be carried out at any time point, as long as it is performed after transferring the color material layer(s) at least once. In other words, the shifting may be carried out before or after the second or subsequent transfer of the color material layer, or alternatively, after the transfer of the color material layer(s) (after the completion of the image formation) and before or after the transfer of the protective layer. However, in terms of preventing the occurrence of image defects, and facilitating the operation, the shifting is preferably performed after the transfer of the color material layer(s) and before the transfer of the transferable protective layer.

Further, it is preferred that the distance q, which is a distance by which the relative positions of the thermal head and the transfer receiving material with respect to each other are to be shifted, and the dot pitch of the thermal head, which is taken as p, satisfy the following Inequality (1). When q and p satisfy the following Inequality (1), the smoothness and the glossiness of the surfaces of the resulting image and protective layer can further be improved.

$$0.4 \leq q/p \leq 0.6 \quad (1)$$

Next, a description will be given regarding the method for forming an image and a protective layer, on the transfer receiving material 200 in one embodiment, with reference to FIG. 5. First, the transfer receiving material 200 is fed from a supply roller 50, and the thermal transfer sheet 100 is fed from a supply roll 51. The transfer receiving material 200 and the thermal transfer sheet 100 are transported between the thermal head 52 and a platen roller 53, which are disposed so as to be pressable against each other, with the color material layer(s) and the transferable protective layer of the thermal transfer sheet 100 and the transfer receiving material 200 being layered and sandwiched therebetween. The thermal head 52 is then allowed to generate heat according to image data, and the color material(s) contained in the color material layer(s) of the thermal transfer sheet 100 is/are transferred onto the transfer receiving material 200, to form an image on the receiving layer. Subsequently, the thermal head 52 is shifted by a stepping motor 54 in the direction substantially in parallel with the main scanning direction (the direction in which the heat generating portions of the thermal head 52 are arranged). After shifting the position of the thermal head, the transferable protective layer provided on the thermal transfer sheet 100 is transferred onto the formed image, to form a protective layer on the image. Thereafter, the thermal transfer sheet 100 and the transfer receiving material 200 are wound up by winding rolls 56 and 55, respectively.

<Apparatus for Forming Image and Protective Layer>

In one embodiment, the apparatus for forming an image and a protective layer according to the invention comprises a shifting unit shifting the relative positions of the thermal head and the transfer receiving material with respect to each other, in the direction substantially in parallel with the main scanning direction. Further, in one embodiment, the apparatus for forming an image and a protective layer comprises the thermal head, and the platen roller disposed opposite to the thermal head; and the thermal head comprises a plurality of the heat generating portions which is arranged (aligned) so as to extend substantially in parallel with each other. This apparatus further comprises: (1) a supplying unit supplying the thermal transfer sheet between the thermal head and the platen roller, wherein the thermal transfer sheet comprises a plurality of the color material layers and the transferable protective layer which are arranged in a face serial manner; (2) a transferring unit transfering the color material layers of the thermal transfer sheet onto the transfer receiving material, by heat of the thermal head, to form an image on the transfer receiving material; (3) a transferring unit transfering the transferable protective layer provided on the thermal transfer sheet onto the transfer receiving material, by heat of the thermal head, to form a protective layer on the transfer receiving material; and (4) a shifting unit shifting the relative positions of the thermal head and the transfer receiving material with respect to each other, in the direction substantially in parallel with the main scanning direction, after transferring the color material layers at least once. Preferred embodiments of the thermal transfer sheet, the transfer receiving material and the like will not be described here, since they are the same as described above.

EXAMPLES

<Production of Thermal Transfer Sheet>

A polyethylene terephthalate film having a thickness of 4.5 μm was used as a substrate, and a coating liquid for forming a heat-resistant lubricant layer, having the following composition, was coated on the substrate, such that the coating amount thereof in a dried state was 0.8 g/m$^2$, to form a heat-resistant lubricant layer.

| (Coating Liquid for Forming Heat-Resistant Lubricant Layer) | |
|---|---|
| Polyvinyl butyral (hydroxyl value: 16% by mass) (trade name: S-LEC (registered trademark) BX-1; manufactured by Sekisui Chemical Co., Ltd.) | 2.0 parts by mass |
| Polyisocyanate (NCO = 17.3% by mass) (trade name: BURNOCK (registered trademark) D750; manufactured by DIC Corporation) | 4.4 parts by mass |
| Phosphoric acid ester surfactant (trade name: PLYSURF (registered trademark) A208N; manufactured by DKS. Co. Ltd.) | 1.3 parts by mass |
| Filler (trade name: MICRO ACE (registered trademark) P-3; manufactured by Nippon Talc Co., Ltd.) | 0.3 parts by mass |
| Methyl ethyl ketone | 43.6 parts by mass |
| Toluene | 43.6 parts by mass |

A coating liquid for forming a color material primer layer, having the following composition, was coated by gravure coating, on a portion of the surface of the substrate opposite from the surface provided with the heat-resistant lubricant layer, such that the coating amount thereof in a dried state was 0.10 g/m$^2$, and then dried, to form a color material primer layer.

| (Coating Liquid for Forming Color Material Primer layer) | |
|---|---|
| Alumina sol (average primary particle diameter: 10 nm × 100 nm, solids content: 10%) (trade name: alumina sol 200; manufactured by Nissan Chemical Industries, Ltd.) | 30 parts by mass |
| Polyvinyl pyrrolidone (trade name: K-90; manufactured by ISP Corporation) | 3 parts by mass |
| Water | 50 parts by mass |
| Isopropyl alcohol | 17 parts by mass |

Subsequently, a coating liquid (Y) for forming a yellow color material layer, a coating liquid (M) for forming a magenta color material layer, and a coating liquid (C) for forming a cyan color material layer, having the following compositions, respectively, were coated on the thus formed color material primer layer, by a gravure printing machine. Each coating liquid was coated such that the coating amount in a dried state was 0.6 g/m$^2$, and then dried, and this coating operation was repeated for each coating liquid in a face serial manner, to form color material layers.

| (Coating Liquid (Y) for Forming Yellow Color Material Layer) | |
|---|---|
| Disperse Yellow 201 | 4.0 parts by mass |
| Polyvinyl acetal resin (trade name: S-LEC (registered trademark) KS-5; manufactured by Sekisui Chemical Co., Ltd.) | 3.5 parts by mass |
| Polyethylene wax | 0.1 parts by mass |
| Methyl ethyl ketone | 45.0 parts by mass |
| Toluene | 45.0 parts by mass |

| (Coating Liquid (M) for Forming Magenta Color Material Layer) | |
|---|---|
| Disperse Red 60 | 1.5 parts by mass |
| Disperse Violet 26 | 2.0 parts by mass |
| Polyvinyl acetal resin (trade name: S-LEC (registered trademark) KS-5; manufactured by Sekisui Chemical Co., Ltd.) | 4.5 parts by mass |
| Polyethylene wax | 0.1 parts by mass |

-continued

| (Coating Liquid (M) for Forming Magenta Color Material Layer) | |
|---|---|
| Methyl ethyl ketone | 45.0 parts by mass |
| Toluene | 45.0 parts by mass |

| (Coating Liquid (C) for Forming Cyan Color Material Layer) | |
|---|---|
| Solvent Blue 63 | 2.0 parts by mass |
| Disperse Blue 354 | 2.0 parts by mass |
| Polyvinyl acetal resin (trade name: S-LEC (registered trademark) KS-5; manufactured by Sekisui Chemical Co., Ltd.) | 3.5 parts by mass |
| Polyethylene wax | 0.1 parts by mass |
| Methyl ethyl ketone | 45.0 parts by mass |
| Toluene | 45.0 parts by mass |

On the portion(s) of the substrate where the above described respective color material layers had not been formed, a coating liquid for forming a peeling layer, having the following composition, was coated such that the coating amount thereof in a dried state was 1.0 g/m$^2$, and then dried, to form a peeling layer.

| (Coating Liquid for Forming Peeling Layer) | |
|---|---|
| Acrylic resin (Tg: 105° C.) (trade name: BR-87; manufactured by Mitsubishi Rayon Co., Ltd.) | 100 parts by mass |
| Methyl ethyl ketone | 306 parts by mass |

On the thus formed peeling layer, a coating liquid for forming a primer layer, having the following composition, was coated such that the coating amount thereof in a dried state was 0.2 g/m$^2$, and then dried, to form a primer layer.

| (Coating Liquid for Forming Primer Layer | |
|---|---|
| Alumina sol (average primary particle diameter: 10 nm × 100 nm, solids content: 10%) (trade name: alumina sol 200; manufactured by Nissan Chemical Industries, Ltd.) | 30 parts by mass |
| Polyvinyl pyrrolidone (trade name: K-90; manufactured by ISP Corporation) | 3 parts by mass |
| Water | 50 parts by mass |
| Isopropyl alcohol | 17 parts by mass |

On the thus formed primer layer, a coating liquid for forming an adhesive layer, having the following composition, was coated such that the coating amount thereof in a dried state was 1.0 g/m$^2$, and then dried, to form an adhesive layer.

| (Coating Liquid for Forming Adhesive layer) | |
|---|---|
| Polyester resin (trade name: VYLON (registered trademark) 700; manufactured by TOYOBO Co., Ltd.) | 23.5 parts by mass |
| UVA compound (trade name: TINUVIN 900; manufactured by Ciba Specialty Chemicals Corporation) | 6 parts by mass |
| Silica (trade name: Sylysia 310P; manufactured by Fuji Silysia Chemical Ltd.) | 0.5 parts by mass |
| Toluene | 35 parts by mass |
| Methyl ethyl ketone | 35 parts by mass |

<Preparation of Transfer Receiving Material>

On a porous layer composed of a porous polyethylene film (thickness: 35 μm; trade name: TOYOPEARL (registered trademark) -SS P4255; manufactured by TOYOBO Co., Ltd.), a coating liquid for forming an intermediate layer and a coating liquid for forming a receiving layer, having the following compositions, respectively, were sequentially coated by a gravure reverse coating method, and then dried, to form an intermediate layer and a receiving layer. On the surface of the porous polyethylene film opposite from the surface provided with the intermediate layer and the receiving layer, a coating liquid for forming an anchoring layer, having the following composition, was coated by a gravure reverse roll coating method, and then dried, to form an anchoring layer. The resultant was then pasted with an RC base paper (155 g/m$^2$, thickness: 151 μm; manufactured by Mitsubishi Paper Mills Limited), to obtain a transfer receiving material. The coating amounts of the respective coating liquids, in a dried state, were 1.5 g/m$^2$ for the intermediate layer, 5.0 g/m$^2$ for the receiving layer, and 5 g/m$^2$ for the anchoring layer.

| (Coating Liquid for Forming Intermediate Layer) | |
|---|---|
| Polyester resin (trade name: POLYESTER (registered trademark) WR-905; manufactured by Nippon Synthetic Chemical Industry Co., Ltd.) | 50 parts by mass |
| Titanium oxide (trade name: TCA 888; manufactured by Tochem Products Co., Ltd.) | 20 parts by mass |
| Fluorescent whitening agent (trade name: Uvitex BAC; manufactured by Ciba Specialty Chemicals Corporation) | 1.2 parts by mass |
| Water | 14.4 parts by mass |
| Isopropyl alcohol | 14.4 parts by mass |

| (Composition of Coating Liquid for Forming Receiving Layer) | |
|---|---|
| Vinyl chloride-vinyl acetate copolymer (trade name: SOLBIN (registered trademark) C; manufactured by Nissin Chemical Co., Ltd.) | 60 parts by mass |
| Epoxy modified silicone (trade name: X-22-3000T; manufactured by Shin-Etsu Chemical Co., Ltd.) | 1.2 parts by mass |
| Methylstyryl-modified silicone (trade name: X-24-510; manufactured by Shin-Etsu Chemical Co., Ltd.) | 0.6 parts by mass |
| Methyl ethyl ketone | 2.5 parts by mass |
| Toluene | 2.5 parts by mass |

| (Coating Liquid for Forming Anchoring Layer) | |
|---|---|
| Polyurethane resin (trade name: TAKELAC (registered trademark) A-969V; manufactured by Mitsui Chemicals, Inc.) | 30 parts by mass |
| Polyisocyanate (trade name: TAKENATE (registered trademark) A-5; manufactured by Mitsui Chemicals, Inc.) | 10 parts by mass |
| Ethyl acetate | 100 parts by mass |

<Formation of Image and Protective Layer>

Example 1

Figure 5:
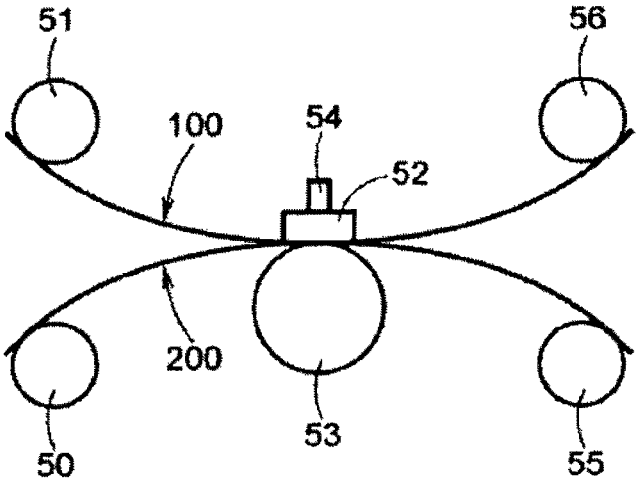
FIG. 5 is a schematic diagram showing an apparatus for forming an image and a protective layer, according to the present invention.

In a thermal printer 500 (gradation control system; a multi pulse system in which the number of divided pulses, obtained by dividing one line period into 256 pulses or the like, can be varied from 0 to 255) shown in FIG. 5, the thermal transfer sheet 100 was fed from the supply roll 51, and the transfer receiving material 200 was fed from the supply roller 50, and both were supplied between the thermal head 52 and the platen roller 53. The thermal head 52 and the platen roller 53 had been disposed so as to be pressable against each other, with the color material layers (not shown) and the transferable protective layer (namely, the peeling layer, the primer layer and the adhesive layer) of the thermal transfer sheet 100, and the receiving layer of the transfer receiving material 200, being layered and sandwiched therebetween. The thermal head (trade name: KEE-57-12GAN2-STA; manufactured by KYOCERA Corporation) used was one including a plurality of heat generating portions extending substantially in parallel with each other, and the dot pitch p of the heat generating portions was 84 μm.

Next, the thermal head 52 was allowed to generate heat according to image data, and the color materials contained in the color material layers of the thermal transfer sheet 100 were transferred onto the receiving layer on the transfer receiving material 200, to form an image on the receiving layer. The conditions of the thermal printer were as follows.

Average resistance value of heat generating elements: 3303 (Ω)
Printing density in main scanning direction: 300 (dpi)
Printing density in sub-scanning direction: 300 (dpi)
Printing voltage: 22.5 (V)
One line period: 3.0 (msec.)
Print starting temperature: 35 (° C.)
Pulse duty: 85%

After the completion of the image formation, the position of the thermal head 52 was moved by the stepping motor 54 which had been set to move the position of the thermal head 52 by 34 μm (about 0.4 times the dot pitch p) in the direction substantially in parallel with the main scanning direction.

Subsequently, the transferable protective layer provided on the thermal transfer sheet 100 was transferred onto the formed image, to form a protective layer on the image. The conditions of the thermal printer were as follows.

Average resistance value of heat generating elements: 3303 (Ω)
Printing density in main scanning direction: 300 (dpi)
Printing density in sub-scanning direction: 300 (dpi)
Printing voltage: 18 (V)
One line period: 3.0 (msec.)
Print starting temperature: 35 (° C.)
Pulse duty: 85%

The transfer receiving material 200 and the thermal transfer sheet 100 which had passed through between the thermal head 52 and the platen roller 53 were wound up by the winding roll 55 and the winding roll 56, respectively.

Example 2

The same procedure as in Example 1 was repeated, except that the stepping motor 54 had been set so as to move the position of the thermal head 52 by 50 μm (about 0.6 times the dot pitch p) in the direction substantially in parallel with the main scanning direction, to form a protective layer on the image.

Example 3

The same procedure as in Example 1 was repeated, except that the stepping motor 54 had been set so as to move the position of the thermal head 52 by 25 μm (about 0.3 times the dot pitch p) in the direction substantially in parallel with the main scanning direction, to form a protective layer on the image.

Example 4

The same procedure as in Example 1 was repeated, except that the stepping motor 54 had been set so as to move the position of the thermal head 52 by 60 μm (about 0.7 times the dot pitch p) in the direction substantially in parallel with the main scanning direction, to form a protective layer on the image.

Comparative Example 1

The same procedure as in Example 1 was repeated, except that a thermal printer which does not comprise the stepping motor 54 was used, to form an image and a protective layer on the receiving layer of the transfer receiving material.

<<Glossiness Test>>

The glossiness of each of the protective layers on the images, formed in Examples and Comparative Example 1, was measured by Gloss Meter VG2000, manufactured by Nippon Denshoku Industries Co., Ltd. The glossiness was measured at a measurement angle of 20 degrees. The measurement was performed in two different directions, and the transport direction of the transfer receiving material was taken as the sub-scanning direction, and direction 90 degrees rotated from the sub-scanning direction was taken as the main scanning direction. Table 1 shows the values of specular gloss measured at a measurement angle of 20 degrees, as defined in JIS Z 8741 (issued 1997).

<<Smoothness Test>>

The haze value of each of the protective layers on the images, formed in Examples and Comparative Example 1, was measured using Micro-Haze Plus, manufactured by BYK-Gardner (GmbH), in accordance with JIS K 7136 (issued 2000). This measurement detects diffused light outside the specular reflection of light irradiated to the surface of an object to be measured. A lower measurement value indicates a smoother surface with less diffused light. The value obtained in this measurement is used for determining the smoothness of the surface of a printed matter. The haze value was measured at a measurement angle of 2 degrees. The measurement was performed in two different directions, and the transport direction of the transfer receiving material was taken as the sub-scanning direction, and direction 90 degrees rotated from the sub-scanning direction was taken as the main scanning direction. Table 1 shows the haze values as measured at a measuring angle of 2 degrees.

TABLE 1

| | Glossiness | | Haze value | |
|---|---|---|---|---|
| | Sub-scanning direction | Main scanning direction | Sub-scanning direction | Main scanning direction |
| Example 1 | 51 | 39 | 11 | 12 |
| Example 2 | 53 | 40 | 12 | 11 |
| Example 3 | 47 | 38 | 15 | 20 |
| Example 4 | 48 | 38 | 15 | 19 |
| Comparative Example 1 | 45 | 38 | 18 | 23 |

DESCRIPTION OF SYMBOLS

10: substrate
11: color material layer

12: transferable protective layer
13: color material primer layer
14: peeling layer
15: primer layer
16: adhesive layer
17: heat-resistant lubricant layer
21: substrate sheet
22: receiving layer
23: intermediate layer
24: back layer
30: heat generating portion
50, 51: supply roller
52: thermal head
53: platen roller
54: stepping motor
55, 56: winding roll
100: thermal transfer sheet
200: transfer receiving material
p: dot pitch
x: direction substantially in parallel with main scanning direction (direction in which heat generating portions are arranged)
y: transport direction (sub-scanning direction) of thermal transfer sheet and transfer receiving material

The invention claimed is:

1. A method for forming an image and a protective layer on a transfer receiving material, by thermal transfer, the method comprising:

supplying a thermal transfer sheet between a thermal head of a thermal printer and a platen roller disposed opposite to the thermal head, wherein the thermal transfer sheet comprises a plurality of color material layers and a transferable protective layer which are arranged in a face serial manner, and wherein the thermal head comprises a plurality of heat generating portions which is arranged so as to extend substantially in parallel with each other;

transferring the color material layers of the thermal transfer sheet onto the transfer receiving material, by heat of the thermal head, to form an image on the transfer receiving material;

transferring the transferable protective layer of the thermal transfer sheet onto the transfer receiving material, by heat of the thermal head, to form a protective layer on the transfer receiving material; and shifting the relative positions of the thermal head and the transfer receiving material with respect to each other, in a direction substantially in parallel with a main scanning direction, after transferring the color material layers at least once;

wherein the shifting is carried out after transferring the color material layers, and before transferring the transferable protective layer, onto the transfer receiving material; and wherein, when a dot pitch of the plurality of heat generating portions of the thermal head is taken as p, and a distance by which the relative positions of the thermal head and the transfer receiving material with respect to each other are to be shifted is taken as q, p and q satisfy the following Inequality (1):

$$0.4 \leq q/p \leq 0.6 \quad (1).$$

2. An apparatus for forming an image and a protective layer on a transfer receiving material, the apparatus comprising:

a thermal printer having a thermal head comprising a plurality of heat generating portions which are arranged so as to extend substantially in parallel with each other, and a platen roller disposed opposite to the thermal head;

a supplying unit for supplying a thermal transfer sheet comprising a plurality of color material layers and a transferable protective layer, which are arranged in a face serial manner, and a transfer receiving material disposed between the thermal head and the platen roller; and a shifting unit that shifts the relative positions of the thermal head and the transfer receiving material with respect to each other in a direction that is substantially parallel with respect to a main scanning direction, after transferring the color material layer, and before transferring the transferable protective layer, onto the transfer receiving material, wherein, when a dot pitch of the plurality of heat generating portions of the thermal head is taken as p, and a distance by which the relative positions of the thermal head and the transfer receiving material with respect to each other are to be shifted is taken as q, p and q satisfy the following Inequality (1):

$$0.4 \leq q/p \leq 0.6 \quad (1).$$

* * * * *